United States Patent [19]

Kilpela et al.

[11] 4,282,910

[45] Aug. 11, 1981

[54] FINGERLING SHEAR

[75] Inventors: Tauno B. Kilpela, Atlantic Mine; Bruce A. Haataja, Lake Linden, both of Mich.

[73] Assignee: Michigan Technological University, Houghton, Mich.

[21] Appl. No.: 168,366

[22] Filed: Jul. 10, 1980

[51] Int. Cl.[3] ..... B27L 7/00

[52] U.S. Cl. ..... 144/3 K; 83/666; 83/672; 144/176; 144/188; 144/193 R; 144/323; 144/34 E

[58] Field of Search ..... 241/92, 278; 144/162 R, 144/176, 3 R, 193 R, 193 D, 323, 326 R, 3 K, 34 R, 34 E, 185, 188; 83/333–336, 391, 394

[56] References Cited

U.S. PATENT DOCUMENTS

| | | | |
|---|---|---|---|
| 1,604,158 | 10/1926 | Finsterwald | 144/188 |
| 1,895,048 | 1/1933 | Rose | 83/666 |
| 2,663,506 | 12/1953 | Vaughan | 144/176 |
| 3,392,763 | 7/1968 | Ledergerber | 144/176 |
| 3,918,476 | 11/1975 | Jasinski | 144/34 E |
| 3,969,966 | 7/1976 | Dillon | 83/672 |
| 4,053,004 | 10/1977 | Barwise et al. | 144/162 R |

FOREIGN PATENT DOCUMENTS

| | | | |
|---|---|---|---|
| 680689 | 8/1979 | U.S.S.R. | 144/3 K |

*Primary Examiner*—W. D. Bray

*Attorney, Agent, or Firm*—Michael, Best & Friedrich

[57] ABSTRACT

A fingerling shear for shearing a length of wood in a plane transverse to the grain direction and for splitting the sheared length along the grain direction to form a plurality of fingerlings. The shear includes a planar shearing blade, supported for rotation about a generally vertical axis, the planar shearing blade including an involute cutting edge adapted to engage the elongated piece of wood during rotation of the blade and for shearing off a length of that piece of wood, and a plurality of splitting blades fixed to the lower surface of the planar shearing blade and spaced along the involute cutting edge, the splitting blades each including a leading cutting edge spaced from the involute cutting edge of the planar blade and extending tranversely to the lower surface, the cutting edges of the splitting blades being adapted to sequentially engage portions of the sheared length of the wood stock to sequentially split fingerlings from the sheared length.

7 Claims, 2 Drawing Figures

FINGERLING SHEAR

FIELD OF THE INVENTION

The invention relates to apparatus for use in reducing otherwise waste wood products to a usable form, and more particularly comprises a fingerling shear for use in severing wood pieces such as stems and branches into relatively short lengths while splitting those short lengths into a plurality of fingerlings.

BACKGROUND PRIOR ART

Attention is directed to the Barwise, et al. U.S. Pat. No. 4,053,004, issued October 11, 1977; the Vaughan U.S. Pat. No. 2,663,506, issued Dec. 22, 1953; and the Finsterwald, U.S. Pat. No. 1,604,158, issued Oct. 26, 1926.

Attention if further directed to the Jasinski, U.S. Pat. No. 3,918,476, issued Nov. 11, 1975; and the Ledergerber U.S. Pat. No. 3,392,763.

SUMMARY OF THE INVENTION

The invention includes a fingerling shear which generally includes means for supporting an elongated piece of wood and means for shearing a length of the elongated wood in a plane transverse to the grain direction and for splitting the sheared length along the grain direction to form a plurality of fingerlings. The shearing means comprises a planar shearing blade supported for rotation about a generally vertical axis and having an involute cutting edge adapted to engage the elongated piece of wood during rotation of the blade and for shearing off short lengths of that piece of wood. A plurality of splitting blades are fixed to the lower surface of the planar shearing blade and are spaced along the involute cutting edge. The splitting blades each include a leading cutting edge spaced from the involute cutting edge of the planar blade and extending transversely to the lower surface, the cutting edges of the splitting blades being adapted to sequentially engage portions of the sheared length to sequentially split fingerlings from the sheared length.

The means for supporting and feeding the wood toward the involute blade comprises an elongated tube for housing lengths of wood and for slideably feeding the wood in the grain direction toward the cutting blade.

Various other features and advantages of the invention are set forth in the following description, in the claims and in the drawings.

Figure 2:
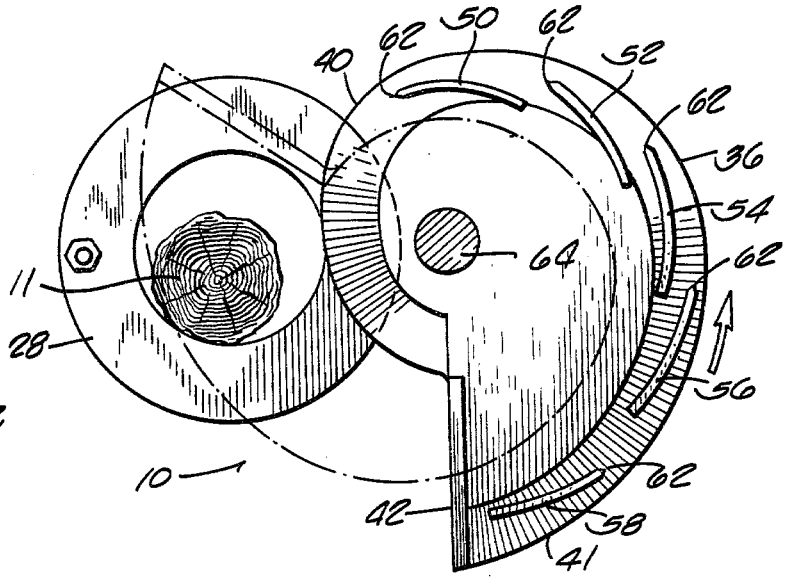
FIG. 2 is a view taken along line 2—2 in FIG. 1.

Before explaining one embodiment of the invention in detail, it is to be understood that the invention is not limited in its application to the details of construction and the arrangements of the components set forth in the following description or illustrated in the drawings. The invention is capable of other embodiments and of being practiced and carried out various ways. Also, it should be understood that the phraseology and terminology employed herein is for the purpose of description and should not be regarded as limiting.

DESCRIPTION OF A PREFERRED EMBODIMENT

Figure 1:
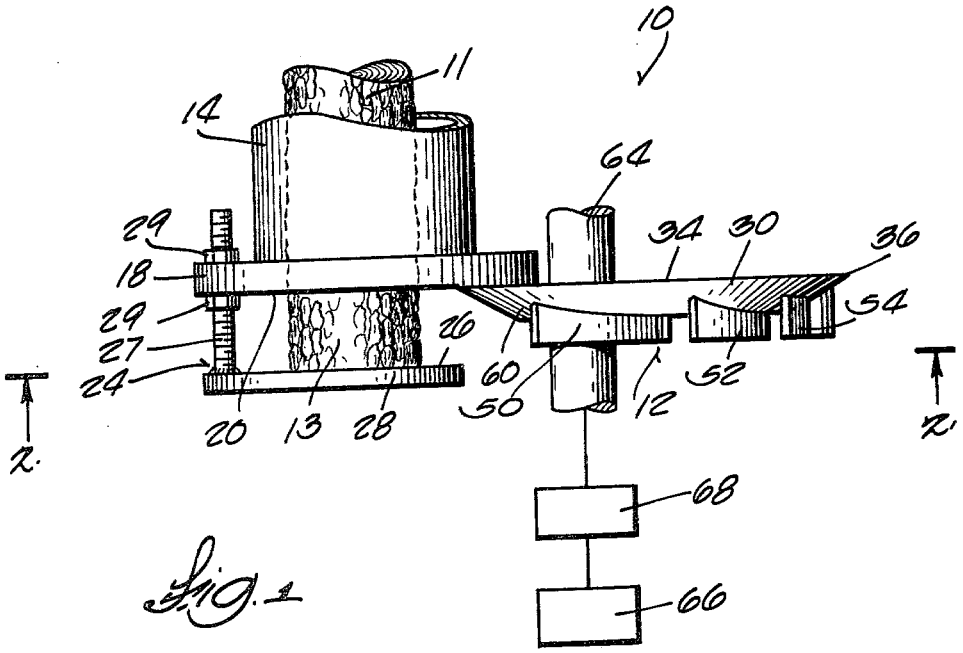
FIG. 1 is an elevation view of a portion of a fingerling shear embodying the invention.

Illustrated in FIG. 1 is a shearing mechanism 10 for use in shearing relatively short segments of tree stems, branches, slabs or edgings 11 and for splitting the cut segments along their grain to produce fingerlings having sizes acceptable for use in a flaking machine.

The shearing mechanism 10 includes a means for supporting the stems, branches or the like 11 such that they can be fed linearly, i.e. in the direction of their grain, toward a position wherein a short end portion 13 thereof can be sheared by a shearing blade 12. While various arrangements can be provided, in the illustrated construction, the means for supporting the stems 11 includes a stock tube 14 mounted vertically in such a manner that the stems 11 can be gravity fed through the tube 14 toward the shearing blade 12. The lower end of the stock tube 14 includes an outwardly extending peripheral flange 18 providing a planar end surface 20. In the illustrated construction, the stock tube 14 has an inside diameter capable of receiving branches, stems and the like 11 up to 6 inches in diameter. As will be readily appreciated, the stock tube 14 could also be of other convenient sizes.

Means are also provided for regulating the length of the sections 13 of the stems 11 to be cut off, for thereby controlling the lengths of the resultant fingerlings. While various constructions can be provided, in the illustrated arrangement, the means for regulating the lengths of the stem sections 13 to be formed, includes a length stop 24 comprising a stop plate 28 supported parallel to the lower surface 20 of the peripheral flange 18 and including an upper surface 26 adapted to support the lower end the stem 11 being fed through the stock tube 14.

Means are also provided for supporting the stop plate 28 for adjustable movement toward and away from the end of the stock tube 14. In the illustrated construction, such means comprises a bolt 27 welded to the stop plate 28. The bolt 27 extends through a bore in the flange 18 and is supported by a pair of nuts 29. While the stop plage 28 is illustrated as being positioned so as to yield sections 13 of approximately 3 inches, the position of the stop plate 28 is adjustable to facilitate cutting of fingerlings from 1 to 6 inches in length.

The means 12 for sheering off the stem portions 13 projecting from the stock tube 14 includes an involute knife 30 supported for rotation about an axis 32 parallel to and spaced from the longitudinal axis of the stock tube 14. The involute knife 30 includes an upper planar surface 34 positioned so as to be generally slidable against the planar lower surface 20 of the peripheral flange 18. As shown in FIG. 2, the peripheral cutting edge 36 of the knife generally forms an involute curve, and the knife 30 is adapted to rotate in a counterclockwise direction as viewed in FIG. 2 about the axis 32. Stated alternatively, the involute knife 30 comprises an eccentric blade, the cutting edge 36 of the blade having a radius of curvature which increases in the rotational direction opposite to the direction of rotation of the blade, whereby upon rotation of the blade, once the cutting edge 36 of the blade engages the stem, as the blade 30 continues to rotate, the cutting edge 36 will cut increasingly deeper through the stem 11 until it severs the stem. As shown in FIG. 2, the cutting edge 36 of the blade 30 includes a leading edge portion 40 or small radius portion having a radius equal to the distance between the axis of rotation 32 of the blade and the adjacent inside surface portion of the stock tube 14. When the knife 30 is in the position as shown in FIG. 2, it will be noted that the stem 16 can freely pass through the stock tube 14 since the knife blade 30 does not obstruct the open end of the stock tube. It will also be noted that the radius of curvature of the cutting edge 36 of the blade 30 increases in the direction opposite to the direction of rotation of the blade such that the trailing edge 41 of the blade 30 has a radius of curvature approximating the distance between the axis of rotation 32 of the blade and the opposite side of the stock tube 14. The trailing edge of the knife is truncated to form a linear radially extending rearward edge 42.

The involute knife blade 30 also includes means for splitting the severed segment 13 along its grain as it is being sheared, to thereby form a plurality of fingerlings having a length equal to that of the segment 22 being cut but having a cross sectional size which is reduced and more readily adapted to be fed into a flaker or the like. The means for splitting the severed segments comprises a plurality of splitting blades 50, 52, 54, 56 and 58 fixedly joined to the lower planar surface 60 of the involute knife 30. In the illustrated construction, the splitting blades 50–58 each include a relatively narrow leading cutting edge 62 extending perpendicularly to the surface 60 of the involute knife and spaced radially inwardly from the cutting edge 36 of the involute knife. The splitting blades 50–58 also include an elongated trailing portion being fixedly joined to the lower surface 60 of the involute knife 30 and being curved about the axis of rotation 32 of the knife, the curved trailing portion including a concave surface facing the axis of rotation. The splitting blades 50–58 are disposed in mutually spaced staggered relationship sequentially along the periphery of the cutting edge 36 of the involute knife, and the leading or cutting edges 62 of the splitting knives are disposed at a generally uniformly spaced distance from the cutting edge 36, and the trailing edges of the splitting knives are fixed at a greater distance from the cutting edge of the involute knife.

In operation of the fingerling shear 10 of the invention, a stem or branch 11 is fed down the stock tube 14 so as to rest on the stop plate 28 such that a length or section 13 of the stem, having a length of approximately 3 inches, will project from the lower surface 20 of the peripheral flange 18 of the stock tube. The involute knife 30 rotates about the axis 32 of the shaft 64 in a counterclockwise direction as viewed in FIG. 2. As the knife 30 rotates about its axis, the involute cutting edge 36 will engage the stem 11 and begin to shear the stem in a direction perpendicular to the grain of the stem and adjacent to the lower surface 20 of the peripheral flange 18 of the stock tube 14. As the cutting edge begins to cut through the stem 11, the leading or cutting edge 62 of one of the fingerling splitters 50–58 will then engage the surface of the stem 11, splitting the wood of the stem 11 along its grain. As the involute knife 30 continues to cut deeper through the stem 11 to shear the wood, the remaining fingerlings splitters 50–58 sequentially engage the stem and split additional fingerlings away from the stem. As the involute knife 30 cuts through the stem and continues to rotate about its axis 32, the trailing edge 42 of the involute knife will move past the stock tube 14 thereby permitting an additional length of stem 11 to be gravity fed through the stock tube 14 until the severed end engages the stop plate 28 whereupon the involute knife 30 will severe another length of the stem 11 while the fingerling splitters 50–58 split that severed portion along the grain into a plurality of fingerlings.

While various means can be provided to drive the involute knife, in one construction, that means can comprise a motor 66 which can be a five horsepower, 1750 rpm motor coupled to the knife drive shaft 64 through suitable gearing 68 such that the knife 30 rotates at 15 revolutions per minute.

Various features of the invention are set forth in the following claims.

We claim:

1. A fingerling shear comprising means for supporting an elongated piece of wood having a grain direction, means for shearing a length of the elongated wood in a plane transverse to the grain direction and for splitting the sheared length along the grain direction to form a plurality of fingerlings, said shearing means comprising a planar shearing blade, said blade being supported for rotation about an axis, the planar shearing blade including opposed surfaces and a peripheral involute cutting edge adapted to engage the elongated piece of wood during rotation of the planar shearing blade and for shearing off a length of that piece of wood, and a plurality of splitting blades fixed to one of said surfaces of the planar shearing blade and spaced along the involute cutting edge, the splitting blades each including a leading cutting edge spaced from said involute cutting edge and extending tranversely to said one surface, said cutting edges of said splitting blades being adapted to sequentially engage portions of the sheared length of the wood stock to sequentially split fingerlings from said sheared length.

2. A fingerling shear as set forth in claim 1 wherein the means for shearing includes means for rotating said planar shearing blade about the axis of rotation.

3. A fingerling shear as set forth in claim 1 wherein the splitting blades each include an elongated blade member having a leading edge comprising said cutting edge, opposite lateral edges and a trailing edge with respect to the direction of rotation of the planar shearing blade, one of the lateral edges being fixed to said surface of the planar shearing blade.

4. A fingerling shear as set forth in claim 3 wherein said lateral edges of the splitting blades are curved about the axis of rotation of the planar shearing blade.

5. A fingerling shear as set forth in claim 3 wherein the leading edges of the splitting blades are adjacent said involute cutting edge but spaced a first distance therefrom, and wherein the trailing edges of the splitting blades are spaced from the involute cutting edge by a distance greater than the first distance.

6. A fingerling shear as set forth in claim 1 wherein the means for supporting the elongated piece of wood comprises an elongated tube for housing the elongated piece of wood and for slideably feeding the elongated piece of wood in the grain direction toward the planar shearing blade, wherein said stock tube includes a planar end surface, and wherein the other of the planar surfaces of the planar shearing blade can be slideable against said planar end surface.

7. A fingerling shear comprising means for supporting an elongated piece of wood having a grain direction, means for shearing a length of the elongated wood piece in a plane transverse to the grain direction and for splitting the sheared length along the grain direction to form a plurality of fingerlings, said shearing means comprising a planar shearing blade, said blade being supported for rotation about a generally vertical axis, the planar shearing blade including an upper surface, a lower surface, and a peripheral involute cutting edge adapted to engage the elongated piece of wood during rotation of the blade and for shearing off a length of that piece of wood, and a plurality of splitting blades fixed to the lower surface of the planar shearing blade and spaced along the involute cutting edge, the splitting blades each including a leading cutting edge spaced from the involute cutting edge of the planar blade and extending transversely to the lower surface, said cutting edges of said splitting blades being adapted to sequentially engaged portions of the sheared length of the wood stock to sequentially split fingerlings from said sheared length, said splitting blades each including an elongated blade member having a leading edge comprising said cutting edge, said cutting edge facing the direction of rotation of said planar blade, opposite lateral edges and a trailing edge with respect to the direction of rotation of the planar cutting blade, one of the lateral edges being fixed to the lower surface of the planar blade, and the means for supporting the elongated piece of wood including an elongated generally vertical tube for housing the elongated piece of wood and for slideably feeding the elongated piece of wood in the grain direction toward the planar cutting blade.

* * * * *